US008336883B2

(12) United States Patent
Smalley

(10) Patent No.: US 8,336,883 B2
(45) Date of Patent: Dec. 25, 2012

(54) BALL-STRIKING GAME

(76) Inventor: Thomas Smalley, Boulder, CO (US)

( * ) Notice: Subject to any disclaimer, the term of this patent is extended or adjusted under 35 U.S.C. 154(b) by 935 days.

(21) Appl. No.: 12/354,843

(22) Filed: Jan. 16, 2009

(65) Prior Publication Data

US 2010/0181725 A1 Jul. 22, 2010

(51) Int. Cl.
*A63F 9/24* (2006.01)
*A63F 13/00* (2006.01)

(52) U.S. Cl. ..... 273/317.6; 273/317.7; 273/348; 473/462

(58) Field of Classification Search ..... 273/317.6, 273/317.7, 348; 473/457, 564, 567, 570
See application file for complete search history.

(56) References Cited

U.S. PATENT DOCUMENTS 3,917,264 A * 11/1975 Davidson et al. ..... 473/2
3,918,719 A * 11/1975 Welch ..... 473/409
3,971,560 A * 7/1976 Panosh ..... 473/475
4,002,893 A * 1/1977 Newcomb et al. ..... 473/570
4,150,825 A * 4/1979 Wilson ..... 473/152
4,764,666 A * 8/1988 Bergeron ..... 463/25
4,915,384 A * 4/1990 Bear ..... 473/451
4,941,662 A * 7/1990 DePerna ..... 273/317.6
4,995,607 A * 2/1991 Whitfield ..... 473/454
5,007,647 A * 4/1991 Gulick ..... 473/200
5,080,359 A * 1/1992 Thill ..... 473/570
5,091,265 A * 2/1992 Kennedy et al. ..... 428/690
5,111,410 A * 5/1992 Nakayama et al. ..... 434/258
5,114,155 A * 5/1992 Tillery et al. ..... 273/371
5,333,874 A * 8/1994 Arnold et al. ..... 473/156
5,354,063 A * 10/1994 Curchod ..... 473/156
5,401,018 A * 3/1995 Kelly et al. ..... 473/430
5,417,438 A * 5/1995 Poff ..... 473/415
5,443,260 A * 8/1995 Stewart et al. ..... 473/451
5,489,241 A * 2/1996 Perrier ..... 473/115
5,507,485 A * 4/1996 Fisher ..... 473/407
5,529,541 A * 6/1996 Perrier ..... 473/54
5,580,063 A * 12/1996 Edwards ..... 273/378
5,592,401 A * 1/1997 Kramer ..... 702/153
5,649,869 A * 7/1997 Infantino et al. ..... 473/118
5,711,727 A * 1/1998 Edge et al. ..... 473/479
5,768,151 A * 6/1998 Lowy et al. ..... 463/2
5,795,237 A * 8/1998 Miyamoto ..... 473/131
5,868,578 A * 2/1999 Baum ..... 434/247
6,045,465 A * 4/2000 Alfano et al. ..... 473/457
6,074,312 A * 6/2000 Lyon et al. ..... 473/409
6,148,271 A * 11/2000 Marinelli ..... 702/141
6,157,898 A * 12/2000 Marinelli ..... 702/141
6,246,917 B1 * 6/2001 Smith et al. ..... 700/92
6,247,700 B1 * 6/2001 Procupetz ..... 273/408

(Continued)

*Primary Examiner* — Steven J Hylinski
(74) *Attorney, Agent, or Firm* — Jerry Haynes; Law Office of Jerry D. Haynes, P.A.

(57) ABSTRACT

Disclosed is a system for simulating a ball-striking game for a batter in a game area. The system includes a fluorescent bat, a fluorescent ball, a tracking device, and a data computing device. The fluorescent bat is adapted to be held by the batter. The fluorescent ball is adapted to be delivered to the batter for hitting the fluorescent ball with the fluorescent bat. The tracking device is capable of detecting a first set and a second set of parameters associated with the fluorescent ball. Further, the tracking device is capable of wirelessly transmitting the first set and the second set of parameters to the data computing device. The data computing device is capable of generating a score for the batter based on the first set and the second set of parameters.

8 Claims, 1 Drawing Sheet

U.S. PATENT DOCUMENTS

| | | | | |
|---|---|---|---|---|
| 6,304,789 | B1 * | 10/2001 | Shea | 700/92 |
| D473,603 | S * | 4/2003 | Washington et al. | D21/702 |
| 6,605,011 | B1 * | 8/2003 | Yamamoto et al. | 473/455 |
| 6,672,298 | B2 * | 1/2004 | Battersby et al. | 124/78 |
| 7,192,359 | B1 * | 3/2007 | Lundgren et al. | 473/131 |
| 7,739,076 | B1 * | 6/2010 | Vock et al. | 702/182 |
| 7,870,851 | B2 * | 1/2011 | Mahany | 124/56 |
| 2003/0060299 | A1 * | 3/2003 | Perrier et al. | 473/115 |
| 2004/0171430 | A1 * | 9/2004 | Perrier et al. | 473/115 |
| 2004/0220001 | A1 * | 11/2004 | Oister et al. | 473/570 |
| 2005/0170920 | A1 * | 8/2005 | Boyer et al. | 473/570 |
| 2005/0233815 | A1 * | 10/2005 | McCreary et al. | 473/131 |
| 2005/0272516 | A1 * | 12/2005 | Gobush | 473/200 |
| 2005/0277466 | A1 * | 12/2005 | Lock | 463/30 |
| 2006/0160639 | A1 * | 7/2006 | Klein | 473/476 |
| 2007/0167247 | A1 * | 7/2007 | Lindsay | 473/131 |
| 2007/0207873 | A1 * | 9/2007 | Rose | 473/207 |
| 2008/0153634 | A1 * | 6/2008 | Welch | 473/498 |
| 2008/0234073 | A1 * | 9/2008 | Berg et al. | 473/409 |
| 2009/0048044 | A1 * | 2/2009 | Oleson et al. | 473/570 |
| 2009/0111616 | A1 * | 4/2009 | Creelman | 473/415 |

* cited by examiner

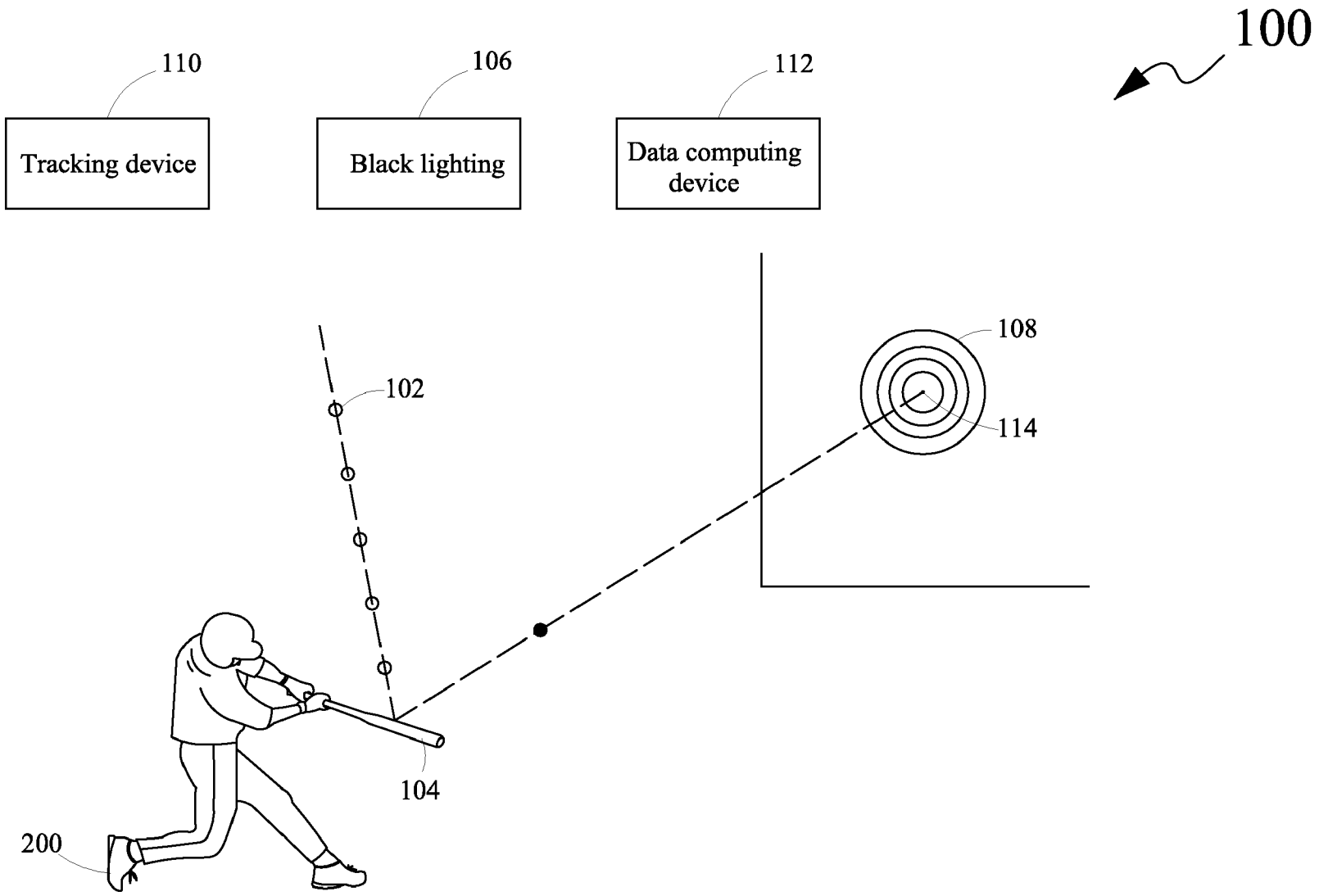
100
112
Data computing device
106
Black lighting
110
Tracking device
108
114
102
104
200

BALL-STRIKING GAME

FIELD OF THE INVENTION

The present invention relates to system for simulating games, and more particularly, to a system for simulating a ball-striking game.

BACKGROUND OF THE INVENTION

Due to hectic lifestyles, people seldom find time for carrying-out physical activities to remain fit and healthy. Accordingly, to carry out physical activities, many individuals usually prefer to play indoor and/or outdoor games with their family members and friends. Further, playing the indoor and/or the outdoor games brings families and friends together, and serves as a good source of rejuvenation. More often than not, the individuals prefer to play ball-striking games, such as baseball.

In general, the ball-striking games, (alternatively referred herein as baseball or ball games) that involve physical activities require involvement of a plurality of players. Moreover, most baseball games are required to be played in daylight to take advantage of visibility. However, such requirements may act as hurdles for individuals desiring to play a game at any point of time and/or in absence of other individuals.

Accordingly, many ball games have been developed that entail a single player. Further, numerous systems have been developed for simulating and analyzing various aspects of the ball games, for a variety of purposes, including amusement and training.

However, such systems are associated with ball-striking games that are non-interactive and unable to serve as a means for excitement while playing. Further, the ball games, as provided by the systems, may become monotonous for a player after some time. More specifically, the systems lack features that may actively involve the player for a lively interaction while playing the ball games. Accordingly, the ball games are incapable of providing a great deal of amusement to the player with varied degrees of skill and knowledge relating to the art of a specific ball game, such as baseball. Furthermore, most of such systems are incapable of enabling the player to play the ball games in the dark.

Accordingly, there is a need for a system for simulating an interactive ball-striking game that may be played by either a single player or a plurality of players. Further, there is a need for a system for simulating a ball-striking game that may be played in daylight as well as in the dark precluding the need of a light source.

SUMMARY OF THE INVENTION

In view of the foregoing disadvantages inherent in the prior art, the general purpose of the present invention is to provide a system for simulating an interactive ball-striking game, to include all the advantages of the prior art, and to overcome the drawbacks inherent therein.

An object of the present invention is to provide a system for simulating an interactive ball-striking game that may be played by a single player or a plurality of players.

Another object of the present invention is to provide a system for simulating an interactive ball-striking game that may be played in daylight as well as in the dark.

In light of the above objects, in one aspect of the present invention, a system for simulating a ball-striking game for a batter is disclosed. The system includes a fluorescent bat, a fluorescent ball, a tracking device and a data computing device. The fluorescent bat is adapted to be held by the batter. The fluorescent ball is adapted to be delivered to the batter, wherein the batter attempts to bat the fluorescent ball with the fluorescent bat. The tracking device is capable of detecting a first set and a second set of parameters associated with the fluorescent ball. Further, the tracking device is capable of wirelessly transmitting the first set and the second set of parameters to the data computing device. The first set of parameters is associated with the fluorescent ball that is being delivered to the batter. Further, the first set of parameters comprises at least one of a trajectory motion of the delivered fluorescent ball, a size of the delivered fluorescent ball and a velocity of the delivered fluorescent ball. The second set of parameters is associated with the fluorescent ball that is being batted by the batter. Further, the second set of parameters comprises at least one of a velocity of the batted fluorescent ball and a trajectory motion of the batted fluorescent ball. The data computing device is wirelessly connected to the tracking device. Further, the data computing device is capable of wirelessly receiving the first set and the second set of parameters transmitted by the tracking device. Furthermore, the data computing device is capable of generating a score for the batter based on the first set and the second set of parameters.

This together with other embodiments of the present invention, along with the various features of novelty that characterize the present invention, is pointed out with particularity in the claims annexed hereto and form a part of this disclosure. For a better understanding of the present invention, its operating advantages, and the specific objects attained by its uses, reference should be made to the accompanying drawings and the descriptive matter in which there are illustrated exemplary embodiments of the present invention.

BRIEF DESCRIPTION OF THE DRAWING

The advantages and features of the present invention will become better understood with reference to the following detailed description and claims taken in conjunction with the accompanying drawing, in which:

FIG. 1 illustrates a view of a game area where a system for simulating a ball-striking game is employed and used by a batter, according to an embodiment of the present invention.

DETAILED DESCRIPTION OF THE INVENTION

The exemplary embodiments described herein detail for illustrative purposes are subject to many variations in structure and design. It should be emphasized, however, that the present invention is not limited to a particular system for simulating a ball-striking game, as shown and described. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of terms, "including," or "comprising," and variations thereof herein is meant to encompass the items listed thereafter and equivalents thereof as well as additional items. Further, the terms "a" and "an" herein do not denote a limitation of quantity, but rather denote the presence of at least one of the referenced item.

Unless limited otherwise, the term "connected" and variations thereof herein are used broadly and encompass direct and indirect connections.

The present invention provides a system for simulating a ball-striking game (hereinafter referred to as "the game"). A suitable example of the game may be a baseball game. The game may be played either by a single player or by plurality of players. The system includes a fluorescent bat and a fluorescent ball that may help a player to play the game in daylight as well as in the dark, and more specifically, at night. Further, the game provides a great deal of amusement to the player with varied degrees of skill and knowledge relating to the art of the game. The system for simulating the game is explained in conjunction with FIG. 1.

FIG. 1 illustrates a view of a game area 100 where a system for simulating a ball-striking game is employed and used by a batter 200, according to an embodiment of the present invention. For the purpose of this description, the ball-striking game refers to a baseball game and the batter 200 refers to a player who attempts to bat. The system for simulating the ball-striking game comprises a ball 102; a bat 104; a light source (optional), such as a black lighting panel 106; a target 108, a tracking device 110, and a data computing device 112.

The ball 102 and the bat 104 may be manufactured using a fluorescent material, and accordingly, the ball 102 and the bat 104 fluoresce when rays of light fall from the black lighting panel 106. Alternately, the ball 102 and the bat 104 may include a coating of the fluorescent material on respective outer surfaces. The ball 102 may hereinafter be referred to as 'fluorescent ball 102,' and the bat 104 may hereinafter be referred to as 'fluorescent bat 104'. The fluorescent bat 104 is adapted to be held by the batter 200. The fluorescent ball 102 is adapted to be delivered to the batter 200 attempting to bat the fluorescent ball 102 with the fluorescent bat 104.

The game may be played by the batter 200 in the game area 100. The game area 100 may be either an open field or a conventional batting cage that may be used for playing the base ball game. The game area 100 includes a home plate (not shown), which is a pentagon and is a part of the baseball game's usual gameplay. Further, the game area 100 includes a batter's box (not shown) that represents a location where the batter 200 stands when ready to play the game. The batter's box is usually drawn in an area adjacent to the home plate.

Further, as the system is equipped with the fluorescent ball 102, the fluorescent bat 104 and the black lighting panel 106, the game may be played in the dark, and more specifically, at night. Said property of the system precludes a need of any other light source for increasing visibility while playing the game in the dark. The black lighting panel 106 may be configured in the game area 100 and may be used to illuminate the fluorescent bat 104 and the fluorescent ball 102. The black lighting panel 106 is a ultraviolet source of light, which enables the batter 200 to view the fluorescent ball 102 and the fluorescent bat 104 clearly and distinctly in the dark, thereby precluding the need of any other source of light.

The game may be played by delivering the fluorescent ball 102 towards the batter 200. The fluorescent ball 102 may be delivered using a pitching means (not shown). The pitching means may be a machine that may be used to deliver the fluorescent ball 102 towards the batter 200. The pitching means may be used by the batter 200 for presetting a trajectory motion and a velocity of the fluorescent ball 102 prior to a delivery thereof. The trajectory motion and the velocity of the fluorescent ball 102 may be set as per the requirements of the batter 200.

When the fluorescent ball 102 is delivered to the batter 200, the batter 200 may use the fluorescent bat 104 to hit (strike) the fluorescent ball 102, such that the fluorescent ball 102 hits the target 108. For batting/hitting the fluorescent ball 102, the batter 200 may need to swing the fluorescent bat 104 when the fluorescent ball 102 is delivered to the batter 200. The fluorescent ball 102, which is delivered to the batter 200 may hereinafter be referred to as 'delivered fluorescent ball 102,' and the delivered fluorescent ball 102 after being batted by the batter 200 may hereinafter be referred to as 'batted fluorescent ball 102'. The target 108 may also be illuminated by the black lighting panel 106 in order to make the target 108 visible in the dark.

The tracking device 110 serves as a sensor system and is capable of detecting a first set and a second set of parameters associated with the fluorescent ball 102. Further, the tracking device 110 is capable of wirelessly transmitting the first set and the second set of parameters. The first set of parameters includes at least one of the trajectory motion of the delivered fluorescent ball 102, size of the delivered fluorescent ball 102 and the velocity of the delivered fluorescent ball 102. The second set of parameters includes at least one of a velocity of the batted fluorescent ball 102 and a trajectory motion of the batted fluorescent ball 102. The second set of parameters may further include a distance between a point, at which the batted ball hits, and a center point 114 of the target 108. Furthermore, the second set of parameters may include scores and batting average values for the batter 200. The scores may relate to hitting a 'double,' 'triple,' 'home run,' and such other scoring values.

Specifically, when the fluorescent ball 102 is delivered towards the batter 200, the tracking device 110 may detect the first set of parameters associated with the delivered fluorescent ball 102. Further, the tracking device 110 may detect the second set of parameters associated with the batted fluorescent ball 102 after the delivered fluorescent ball 102 is batted by the batter 200. The tracking device 110 may be installed in the game area 100 or may be implanted within the fluorescent ball 102. Suitable examples of the tracking device 110 may include, but are not limited to, a radar-positioning sensor, a radio frequency identification (RFID) chip, an optical tracking device and an integrated circuit card capable of tracking and storing the motion of the fluorescent ball 102.

Additionally, the tracking device 110 is further capable of wirelessly transmitting the first set and the second set of parameters to the data computing device 112. The data computing device 112 is capable of wirelessly receiving the first set and the second set of parameters transmitted by the tracking device 110. Further, the data computing device is capable of generating a score for the batter 200 based on the first set and the second set of parameters.

In one embodiment of the present invention, the data computing device 112 may be a smart card capable of storing scores of a plurality of players, such as the batter 200. Further, the data computing device 112 is capable of generating progress path for the plurality of players based on respective first set and second set of parameters. The data computing device 112 is further capable of generating team statistics and scores when the plurality of players is playing the game.

While playing, the batter 200 may receive one or more number of deliveries of the fluorescent ball 102. The skill level may be associated with size of the fluorescent ball 102 and the velocity of the fluorescent ball 102, for example. The batter 200 bats/hits the delivered fluorescent ball 102 and the hits are then tracked with the help of the tracking device 110, and scores are determined by hit type with bonus for hitting the target 108. The batter 200 may have a smart card to sign in into the game and may further track batting average values, scores and statistics using the smart card. Signed-in batters, such as the batter 200, may then collect individual statistics and may join teams or leagues that group and compare statistics.

The present invention provides a system for simulating a ball-striking game, such as a base ball game. The system is capable of being retrofitted in a standard batting cage or open field, and provides an interactive ball-striking gaming experience. The system features fluorescent balls, such as the fluorescent ball 102; fluorescent bats, such as the fluorescent bat 104; and targets, such as the target 108, with score values along with an optional black lighting panel, such as the black lighting panel 106. The system further employs a sensor system that is capable of depicting motion, speed and accuracy of the fluorescent balls used for playing. Further, the system may help determine information such as skill level of a batter as well as scoring by hit type, size of the fluorescent balls and the velocity of the fluorescent balls. Such information may be stored in a smart card or in an integrated circuit card. Furthermore, the system is equipped with a computerized scoring device, such as the data computing device 112, which configures individual and team statistics and scores that may be shared across multiple network linked sites to encourage potential team leagues or tournaments.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

What is claimed is:

1. A system for simulating a ball-striking game for a batter in a game area, the system comprising:

a fluorescent bat adapted to be held by the batter;

a fluorescent ball adapted to be delivered to the batter, wherein the batter attempts to bat the fluorescent ball with the fluorescent bat;

a tracking device capable of detecting a first set and a second set of parameters associated with the fluorescent ball, the tracking device further capable of wirelessly transmitting the first set and the second set of parameters, wherein the first set of parameters is associated with the fluorescent ball being delivered to the batter, the first set of parameters comprising at least one of a trajectory motion of the delivered fluorescent ball, a size of the delivered fluorescent ball and a velocity of the delivered fluorescent ball, and wherein the second set of parameters is associated with the fluorescent ball being batted by the batter, the second set of parameters comprising at least one of a velocity of the batted fluorescent ball and a trajectory motion of the batted fluorescent ball;

a data computing device wirelessly connected to the tracking device, the data computing device capable of wirelessly receiving the first set and the second set of parameters transmitted by the tracking device, the data computing device further capable of generating a score for the batter based on the first set and the second set of parameters;

a pitching means for delivering the fluorescent ball to the batter, where the pitching means is a pitching machine;

a light source in the game area to illuminate the fluorescent bat and the fluorescent ball, where the light source is an ultraviolet light source to allow playing of the ball-striking game in the dark without an additional light source; and a fluorescent target, wherein the batter attempts to hit the fluorescent target with the fluorescent ball.

2. The system of claim 1, wherein the tracking device is implanted in the fluorescent ball.

3. The system of claim 1, wherein the tracking device is a radio-frequency Identification (RFID) chip.

4. The system of claim 1, wherein the tracking device is an optical tracking device.

5. The system of claim 1, wherein the second set of parameters further comprises scores and batting average values.

6. A method of playing a ball-striking game comprising the steps of:

illuminating a game area with a black lighting panel, where the black lighting panel enables play of the ball-striking game in the dark without an additional light source; delivering a fluorescent ball towards a batter by method of a pitching means;

striking the fluorescent ball by swinging a fluorescent bat held by the batter;

hitting a fluorescent target with the fluorescent ball;

tracking the fluorescent ball with a tracking device capable of detecting a first set and a second set of parameters associated with the fluorescent ball;

recording a plurality of statistics by a sensor system pertaining to the batter, the fluorescent bat, and the fluorescent ball;

generating a score for the batter based upon the first set and the second set of parameters; and storing the plurality of statistics on a smart card.

7. The method of playing the ball-striking game according to claim 6 further comprising the step of configuring individual batter and team statistics.

8. The method of playing the ball-striking game according to claim 7 further comprising sharing the individual and team statistics across linked network sites.

* * * * *